US008240282B2

(12) United States Patent
Helmedach

(10) Patent No.: US 8,240,282 B2
(45) Date of Patent: Aug. 14, 2012

(54) VALVE COVER WITH CUSTOM LOOM

(76) Inventor: Eric Helmedach, Saugerties, NY (US)

( * ) Notice: Subject to any disclaimer, the term of this patent is extended or adjusted under 35 U.S.C. 154(b) by 291 days.

(21) Appl. No.: 12/648,375

(22) Filed: Dec. 29, 2009

(65) Prior Publication Data

US 2011/0155094 A1 Jun. 30, 2011

(51) Int. Cl.
*F01M 9/10* (2006.01)

(52) U.S. Cl. ..... 123/90.38; 123/195 C; 123/198 E

(58) Field of Classification Search ..... 123/90.38, 123/195 C, 198 E
See application file for complete search history.

(56) References Cited

U.S. PATENT DOCUMENTS 5,000,218 A * 3/1991 Hayasaki et al. ..... 137/377
5,168,842 A * 12/1992 Brooks ..... 123/143 C
7,430,999 B2 * 10/2008 Schweiger ..... 123/90.38

FOREIGN PATENT DOCUMENTS

JP 10134935 A * 5/1998

* cited by examiner

*Primary Examiner* — Ching Chang

(74) *Attorney, Agent, or Firm* — Jerry D. Haynes; The Law Office of Jerry D. Haynes

(57) ABSTRACT

The present invention relates to a modified valve cover comprising: a top surface area; a plurality grooves over the top surface area; and a means to secure an ignition wire in each groove. The grooves extend vertically and horizontally across the top surface. The means to secure may include a clasping lip along each edge of each groove. In one particular embodiment, the valve cover is manufactured of aluminum. The width of each groove may be one of 6 mm, 7 mm and 8 mm in width. In one exemplary embodiment, the modified valve cover further comprises a cover that attaches to the valve cover and covers the ignition wires within the grooves.

10 Claims, 1 Drawing Sheet

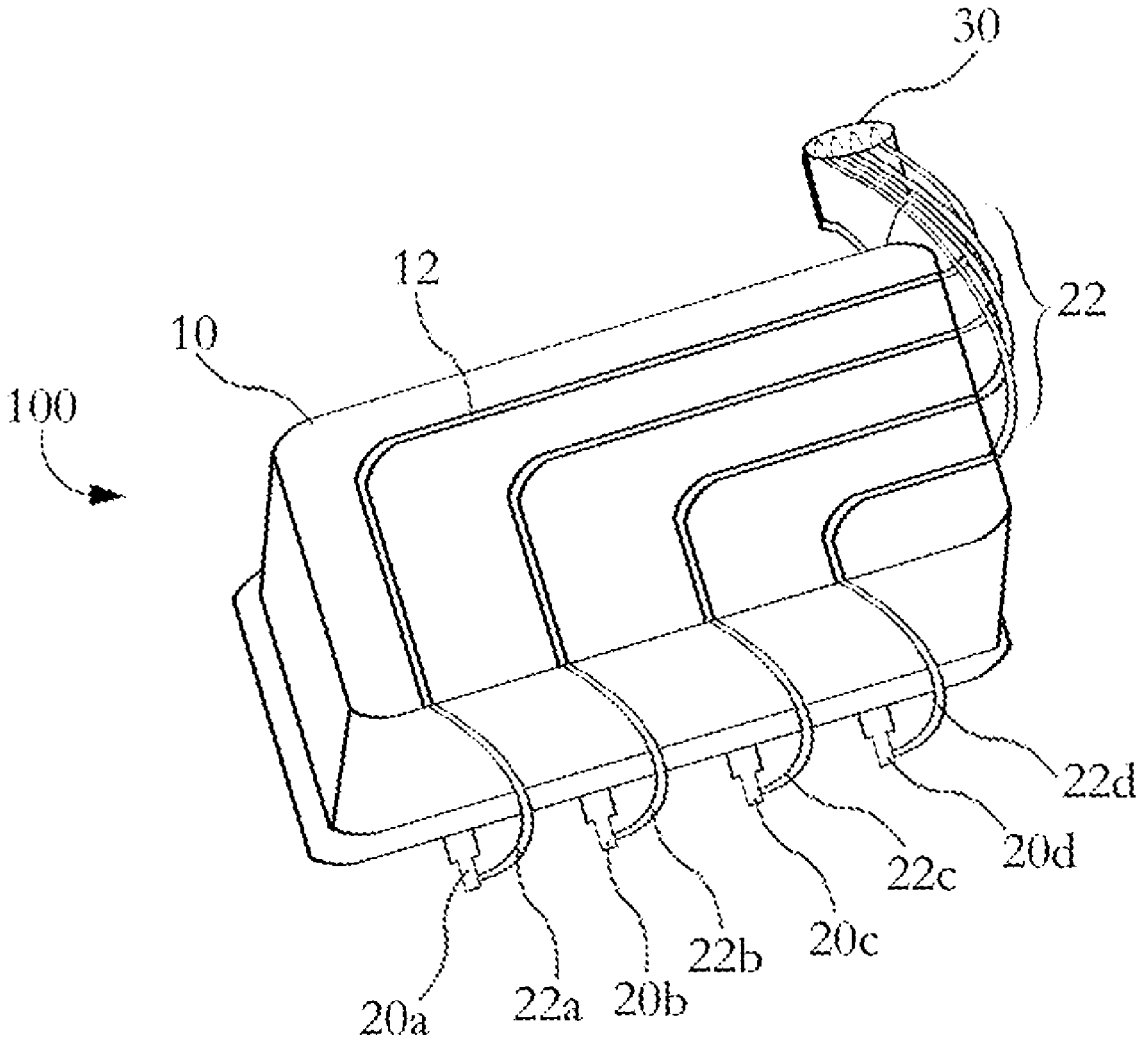
30
12
10
100
22
22d
20d
22c
20c
22b
20b
22a
20a

VALVE COVER WITH CUSTOM LOOM

BACKGROUND OF THE INVENTION

1. Field of Invention

The present invention relates to a modified valve cover that includes a custom loom to secure spark plug wires.

2. Description of Related Art

An essential component of the modern internal combustion engine is valve covers that bolt over rocker arms. Valve covers are critical in covering the rocker arms and ensuring that contamination and proper pressure is provided around the rocker arm area of the combustion engine. A gasket usually seals the valve cover over the rocker arms and ensures that the engine oil remains contained during operation. The valve cover should have sufficient strength and capability to seal and as a result of sealing dampens noise-producing vibrations associated with the moving valves and pistons of the engine.

Valve covers on custom-designed cars and engines usually includes ornamental and aesthetic features to enhance their looks. A custom car or custom engine usually includes chrome components in order to have a very attractive and stylish aesthetic appeal. Many times the valve covers are chrome or painted and have decorative designs that are clearly visible when the hood of the custom vehicle is open. At a car show it is very common for a custom vehicle to have the hood open to display the engine and the inner components thereof.

One feature that would be advantageous to implement onto a valve cover is a loom that could contain sparkplug wires that usually hand loosely in the engine area. Looms provide a means to secure sparkplug wires and therefore increase the aesthetic appeal and overall appearance of the interior engine when on display at a car show. Ignition wires that are allowed to hang loosely sometimes take away from the overall appearance and may diminish the stylish look that is desired with a custom car.

SUMMARY OF THE INVENTION

The present invention relates to a modified valve cover comprising: a top surface area; a plurality grooves over the top surface area; and a means to secure an ignition wire in each groove. The grooves extend vertically and horizontally across the top surface. The means to secure may include a clasping lip along each edge of each groove. In one particular embodiment, the valve cover is manufactured of aluminum. The width of each groove may be one of 6 mm, 7 mm and 8 mm in width. In one exemplary embodiment, the modified valve cover further comprises a cover that attaches to the valve cover and covers the ignition wires within the grooves.

DESCRIPTION OF DRAWINGS

FIG. 1 depicts a modified valve cover with custom looms provided for ignition wires.

DETAILED DESCRIPTION

The present invention provides a modified valve cover that includes a plurality of grooves to conceal and secure ignition wires to provide a more sleek appearance to a custom engine. The present invention supplies the grooves within top surface of the valve cover or so that once the valve cover is installed the ignition wires run along the top cover of the valve cover and are secured in the grooves that are manufactured therein. In an alternative embodiment, the present invention may include a cover that installs over a valve cover to conceal the ignition wires after they have been placed in the grooves.

A modified valve cover 100 is depicted in FIG. 1. The modified valve cover 100 includes a valve cover surface 10 with grooves that extend vertically and horizontally along the surface thereof. The cover surface 10 is designed to have a sufficient number of grooves to accommodate the number of ignition wires that may extend from the spark plugs. As depicted in FIG. 1 four spark plugs 20*a* through 20*d* extend from one side of the engine and accordingly four ignition wires extend from each of the spark plugs 20*a*-20*d*. The ignition wires 22*a* through 22*d* are lead through an individual groove for each ignition wire. A groove 12 is provided for each ignition wire and extends upwardly along the valve cover surface and then horizontally to lead to a distributor 30.

The modified valve cover 100 may include grooves that are manufactured directly into a valve cover or have a cover that may be installed upon a conventional valve cover which includes grooves and securing positions for the ignition wires. Although not depicted in FIG. 1 an additional component of this design and particular embodiment, may include an additional cover that extends over the modified valve cover to completely conceal the ignition wires once they are placed in the grooves. In one exemplary embodiment, the modified cover may be manufactured with polished aluminum and contain 6, 7, or 8 millimeter grooves to secure the exposed ignition wires. Once the wires are placed within the grooves, the engine may be displayed with the wires exposed or with a cover that is secured to conceal the wires.

Although not shown the concealment cover may also have a manufacturer's logo or other aesthetic design placed thereon so that the ignition wires are completely covered and therefore providing a more attractive appearance for the valve cover and ignition wires. The aluminum material used for the modified valve cover 100 must be of sufficient strength to withstand high temperatures that may be associated with any engine during use and modified to fit various engine sizes. The number of grooves provided should be consistent with the number of ignition wires of the engine. Most custom cars have 8 cylinder blocks however some have a 6 cylinder or 12 inline. It is contemplated that the modified valve cover according to the present invention may be developed for each design of various engines and to accommodate the number of ignition wires as needed. The modified valve cover design according to the present invention provides a means to secure ignition wires to increase the aesthetic appeal of a custom car when displayed at a car show. The instant invention has been shown and described in what it considers to be the most practical and preferred embodiments. It is recognized, however, that departures may be made there from within the scope of the invention and that obvious modifications will occur to a person skilled in the art.

What is claimed is:

1. A modified valve cover comprising:

a. a top surface area;

b. a plurality grooves within the top surface area; and c. a means to secure an ignition wire in each groove, where said grooves extend vertically and horizontally across the top surface and each ignition wire extends vertically in each groove and then horizontally leading to a distributor.

2. The modified valve cover according to claim 1, where said means to secure includes a clasping lip along each edge of each groove.

3. The modified valve cover according to claim 1, where said valve cover is manufactured of aluminum.

4. The modified valve cover according to claim 1, including a width associated with each groove, where said width of each groove is at least one of 6 mm, 7 mm and 8 mm in width.

5. The modified valve cover according to claim 1, further comprising a cover that attaches to the valve cover and covers the ignition wires within the grooves.

6. A cover for placement over a valve cover comprising:

a. a top surface area;

b. a plurality grooves within the top surface area; and c. a means to secure an ignition wire in each groove, where said grooves extend vertically and horizontally across the top surface and each ignition wire extends vertically in each groove and then horizontally leading to a distributor; and d. a means to attach the cover over a valve cover.

7. The cover according to claim 6, where said means to secure includes a clasping lip along each edge of each groove.

8. The cover according to claim 6, where said valve cover is manufactured of aluminum.

9. The cover according to claim 6, a width associated with each groove, where said width of each groove is at least one of 6 mm, 7 mm and 8 mm in width.

10. The cover according to claim 6, further comprising a top cover that attaches to the cover and covers the ignition wires within the grooves.

* * * * *